US008459049B2

(12) United States Patent
Li

(10) Patent No.: US 8,459,049 B2
(45) Date of Patent: Jun. 11, 2013

(54) METHOD AND APPARATUS FOR CONTROLLING REFRIGERANT FLOW

(75) Inventor: Jianwu Li, Louisville, KY (US)

(73) Assignee: General Electric Company, Schenectady, NY (US)

( * ) Notice: Subject to any disclaimer, the term of this patent is extended or adjusted under 35 U.S.C. 154(b) by 382 days.

(21) Appl. No.: 12/871,467

(22) Filed: Aug. 30, 2010

(65) Prior Publication Data

US 2012/0047924 A1 Mar. 1, 2012

(51) Int. Cl.
*F25B 41/00* (2006.01)

(52) U.S. Cl.
USPC ..... 62/113; 62/528

(58) Field of Classification Search
USPC ..... 62/113, 190, 528, 222, 129, 126, 62/210
See application file for complete search history.

(56) References Cited

U.S. PATENT DOCUMENTS 4,325,127 A 4/1982 Major
4,403,958 A 9/1983 Lohn
4,756,166 A * 7/1988 Tomasov ..... 62/509
4,932,570 A 6/1990 Gimpera
5,033,272 A * 7/1991 Yoshikawa et al. ..... 62/199
5,129,236 A 7/1992 Solomon
5,174,729 A * 12/1992 Waters et al. ..... 417/310
5,220,225 A 6/1993 Moon, Jr.
5,465,591 A 11/1995 Cur et al.
5,502,970 A * 4/1996 Rajendran ..... 62/115
5,682,757 A * 11/1997 Peterson ..... 62/259.2
5,910,159 A 6/1999 Matsuo et al.
5,938,441 A 8/1999 Brenner
6,058,723 A 5/2000 Kusunoki et al.
6,058,724 A * 5/2000 Park ..... 62/156
6,105,377 A * 8/2000 Jeong et al. ..... 62/180
6,167,712 B1 * 1/2001 Lim et al. ..... 62/113
6,185,948 B1 2/2001 Niki et al.
6,253,561 B1 7/2001 Imakubo et al.
6,321,548 B1 * 11/2001 Clarke et al. ..... 62/222
6,460,357 B1 10/2002 Doi et al.
6,543,245 B1 4/2003 Waldschmidt et al.
7,260,451 B2 * 8/2007 Takai et al. ..... 700/276
7,441,413 B2 10/2008 Bae et al.
7,506,520 B2 3/2009 Oh
7,819,179 B2 * 10/2010 Hayashi et al. ..... 165/263
7,918,655 B2 * 4/2011 Hurst et al. ..... 417/426
8,209,991 B2 7/2012 Kondou et al.
8,215,122 B2 * 7/2012 Hyun et al. ..... 62/200
2003/0089116 A1 5/2003 Heron
2005/0103029 A1 5/2005 Kawahara et al.

* cited by examiner

*Primary Examiner* — Mohammad M Ali
(74) *Attorney, Agent, or Firm* — Global Patent Operation; Douglas D. Zhang

(57) ABSTRACT

Method and apparatus for refrigerant flow control are disclosed. One exemplary method relates to a method of controlling a flow of a refrigerant in an appliance comprising a refrigerant flow controller and a refrigerant flow valve, wherein the refrigerant flow controller is configured to direct the refrigerant flow valve to one of a substantially fully opened position and a substantially fully closed position. The method comprises directing the refrigerant flow valve, via the refrigerant flow controller, to at least one transition position between the substantially fully opened position and the substantially fully closed position, and operating the appliance with the refrigerant flow valve at the at least one transition position.

20 Claims, 10 Drawing Sheets

METHOD AND APPARATUS FOR CONTROLLING REFRIGERANT FLOW

BACKGROUND OF THE INVENTION

The subject matter disclosed herein relates to refrigerator appliances, and more particularly to controlling the flow of a refrigerant in such a refrigerator appliance.

Many existing refrigerator appliances are based on a vapor-compression refrigeration technique. In such a refrigeration technique, a refrigerant serves as the medium that absorbs and removes heat from the space to be cooled, and transfers the heat elsewhere for expulsion. A refrigeration system that performs such a technique typically utilizes a refrigerant flow valve to control the flow of the refrigerant through the system.

Some refrigerator appliances are designed to have two separate evaporators, for example, one serving as an evaporator in a freezer compartment of the refrigerator (i.e., a freezer evaporator) and the other serving as an evaporator in a fresh food compartment of the refrigerator (i.e., a fresh food evaporator). The evaporator is the part of the refrigeration system through which the refrigerant passes to absorb and remove the heat in the compartment being cooled (e.g., freezer compartment or fresh food compartment).

In such dual evaporator refrigeration systems, the refrigerant flow valve is typically a three-way valve with one input port and two output ports, wherein the outputs are coupled to the respective evaporators. Such a three-way valve typically has only four positions to control the flow of the refrigerant through the system. The four positions include: (1) the first output port is blocked and the second output port is coupled to the input port (i.e., the first evaporator is off and the second evaporator is on); (2) the second output port is blocked and the first output port is coupled to the input port (i.e., the first evaporator is on and the second evaporator is off); (3) both output ports are open and coupled to the input port (i.e., both evaporators are on); and (4) both output ports are blocked (i.e., both evaporators are off).

BRIEF DESCRIPTION OF THE INVENTION

As described herein, the exemplary embodiments of the present invention overcome one or more disadvantages known in the art.

One aspect of the present invention relates to a method of controlling a flow of a refrigerant in an appliance comprising a refrigerant flow controller and a refrigerant flow valve, wherein the refrigerant flow controller is configured to direct the refrigerant flow valve to one of a substantially fully opened position and a substantially fully closed position. The method comprises directing the refrigerant flow valve, via the refrigerant flow controller, to at least one transition position between the substantially fully opened position and the substantially fully closed position, and operating the appliance with the refrigerant flow valve at the at least one transition position.

In one illustrative embodiment, the appliance comprises a first evaporator and a second evaporator, and the refrigerant control valve is coupled to the first evaporator and the second evaporator and regulates, responsive to the refrigerant flow controller, respective flow of the refrigerant to the first evaporator and the second evaporator. When the refrigerant flow valve is directed to the at least one transition position, the refrigerant flow to one of the first evaporator and the second evaporator is regulated to a flow rate in between a flow rate associated with the substantially fully opened position and a flow rate associated with the substantially fully closed position, while the refrigerant flow to the other of the first evaporator and the second evaporator is regulated to a flow rate associated with one of the substantially fully opened position and the substantially fully closed position.

The refrigerant flow controller is preferably configured to direct the refrigerant flow valve to two or more transition positions wherein each of the two or more transition positions represents a different flow percentage between about zero percent and about one hundred percent.

Another aspect of the present invention relates to an appliance comprising a refrigerant flow controller and a refrigerant flow valve responsive to the refrigerant flow controller. The refrigerant flow controller is configured to direct the refrigerant flow valve to one of a substantially fully opened position and a substantially fully closed, and to direct the refrigerant flow valve to at least one transition position between the substantially fully opened position and the substantially fully closed position, such that the appliance is operable with the refrigerant flow valve at the at least one transition position.

Yet another aspect of the present invention relates to a dual evaporator refrigerator appliance comprising a first evaporator, a second evaporator, a refrigerant flow controller, a valve driver coupled to the refrigerant flow controller, and a refrigerant flow valve coupled to the valve driver and the first evaporator and the second evaporator for regulating, responsive to the refrigerant flow controller and valve driver, respective flow of a refrigerant to the first evaporator and the second evaporator. The refrigerant flow controller is configured to direct the refrigerant flow valve, via the valve driver, to one of a substantially fully opened position and a substantially fully closed, and to direct the refrigerant flow valve, via the valve driver, to at least one transition position between the substantially fully opened position and the substantially fully closed position, such that the appliance is operable with the refrigerant flow valve at the at least one transition position, and the refrigerant flow to one of the first evaporator and the second evaporator is regulated to a flow rate in between a flow rate associated with the substantially fully opened position and a flow rate associated with the substantially fully closed position, while the refrigerant flow to the other of the first evaporator and the second evaporator is regulated to a flow rate associated with one of the substantially fully opened position and the substantially fully closed position.

Advantageously, illustrative techniques of the present invention provide control of a refrigerant flow valve not only to switch the path of the refrigerant, but also to control the refrigerant flow rate into an evaporator so as to adjust the evaporator temperature in real time to the desired target based on an operating condition and environment.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

One or more of the embodiments of the invention will be described below in the context of a refrigerator appliance such as a household refrigerator. However, it is to be understood that methods and apparatus of the invention are not intended to be limited to use in household refrigerators. Rather, methods and apparatus of the invention may be applied to and deployed in any other suitable environments in which it would be desirable to control refrigerant flow rate and, in the case of a dual evaporator system, flow direction.

While illustrative principles of the invention are particularly well suited for use in a dual evaporator refrigerator appliance, it is to be appreciated that illustrative principles of the invention are also well suited for use in controlling flow rate in single evaporator systems.

Figure 1:
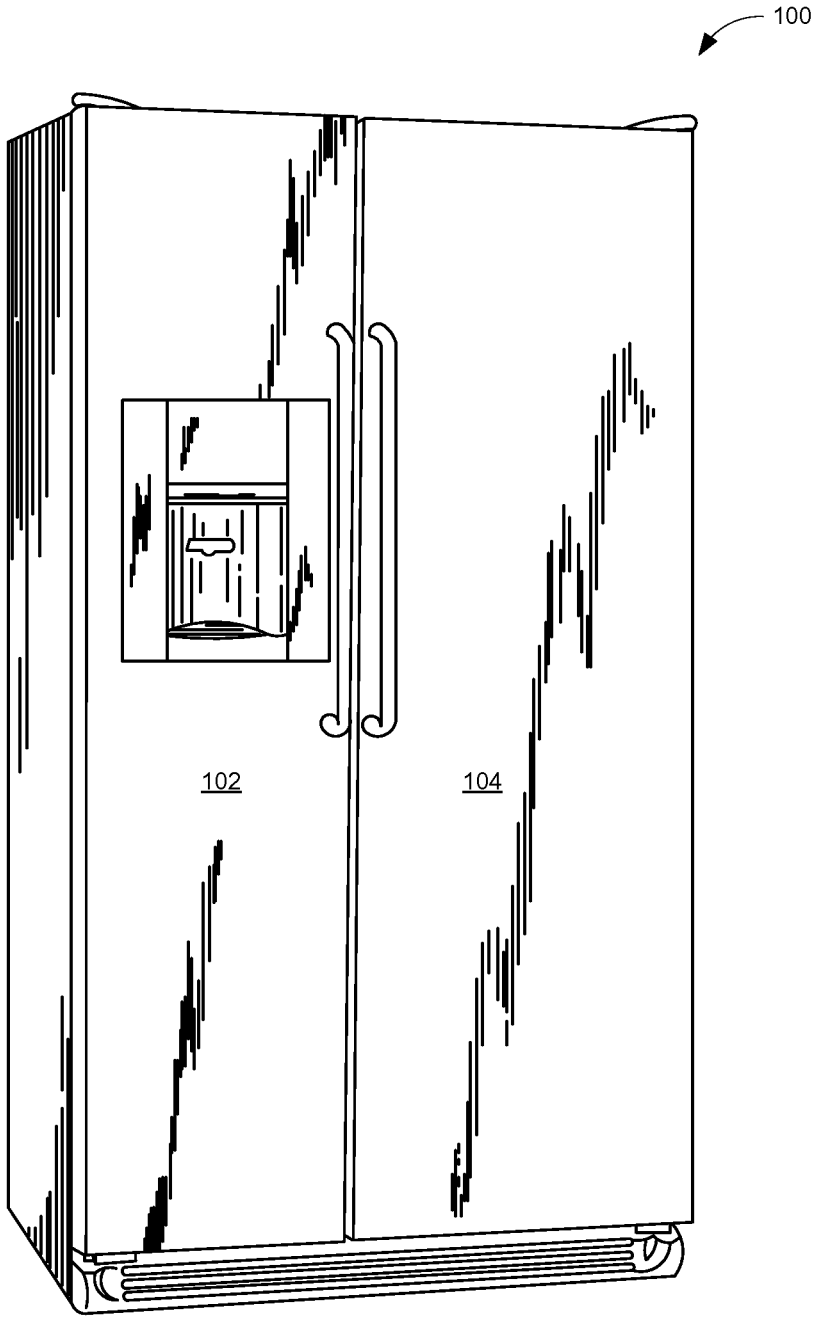
FIG. 1 is a diagram of a refrigerator, in accordance with an embodiment of the invention.

FIG. 1 illustrates an exemplary refrigerator appliance 100 within which refrigerant flow control embodiments of the invention may be implemented. As is typical, a refrigerator has a freezer portion 102 and a refrigerator portion 104. The refrigerator portion typically maintains foods and products stored therein at temperatures at or below about 40 degrees Fahrenheit in order to preserve the items therein, and the freezer portion typically maintains foods and products at temperatures below about 32 degrees Fahrenheit in order to freeze the items therein.

The refrigerator portion 104 may also be referred to as a fresh food compartment, while the freezer portion 102 may be referred to as a freezer compartment. In some refrigerator appliances, a dual evaporator system is used whereby one evaporator is used to cool the freezer compartment and another evaporator is used to cool the fresh food compartment.

While the exemplary refrigerator 100 in FIG. 1 illustrates the freezer portion 102 and the refrigerator portion 104 in a side-by-side configuration, it is to be understood that other configurations are known, such as top freezer configurations where the freezer portion 102 is situated on top of the refrigerator portion 104, and bottom freezer configurations where the freezer portion 102 is situated below the refrigerator portion 104. Also, viewing the refrigerator 100 from the front, the freezer portion 102 may be located to the right of the refrigerator portion 104, as opposed to being located to the left as shown in FIG. 1.

It is to be appreciated that refrigerant flow control embodiments of the invention may be implemented in the refrigerator 100. However, methods and apparatus of the invention are not intended to be limited to implementation in a refrigerator such as the one depicted in FIG. 1. That is, the inventive methods and apparatus may be implemented in other household refrigerator appliances, as well as non-household (e.g., commercial) refrigerator appliances. Furthermore, such inventive methods and apparatus may be generally implemented in any appropriate refrigeration system.

Figure 2:
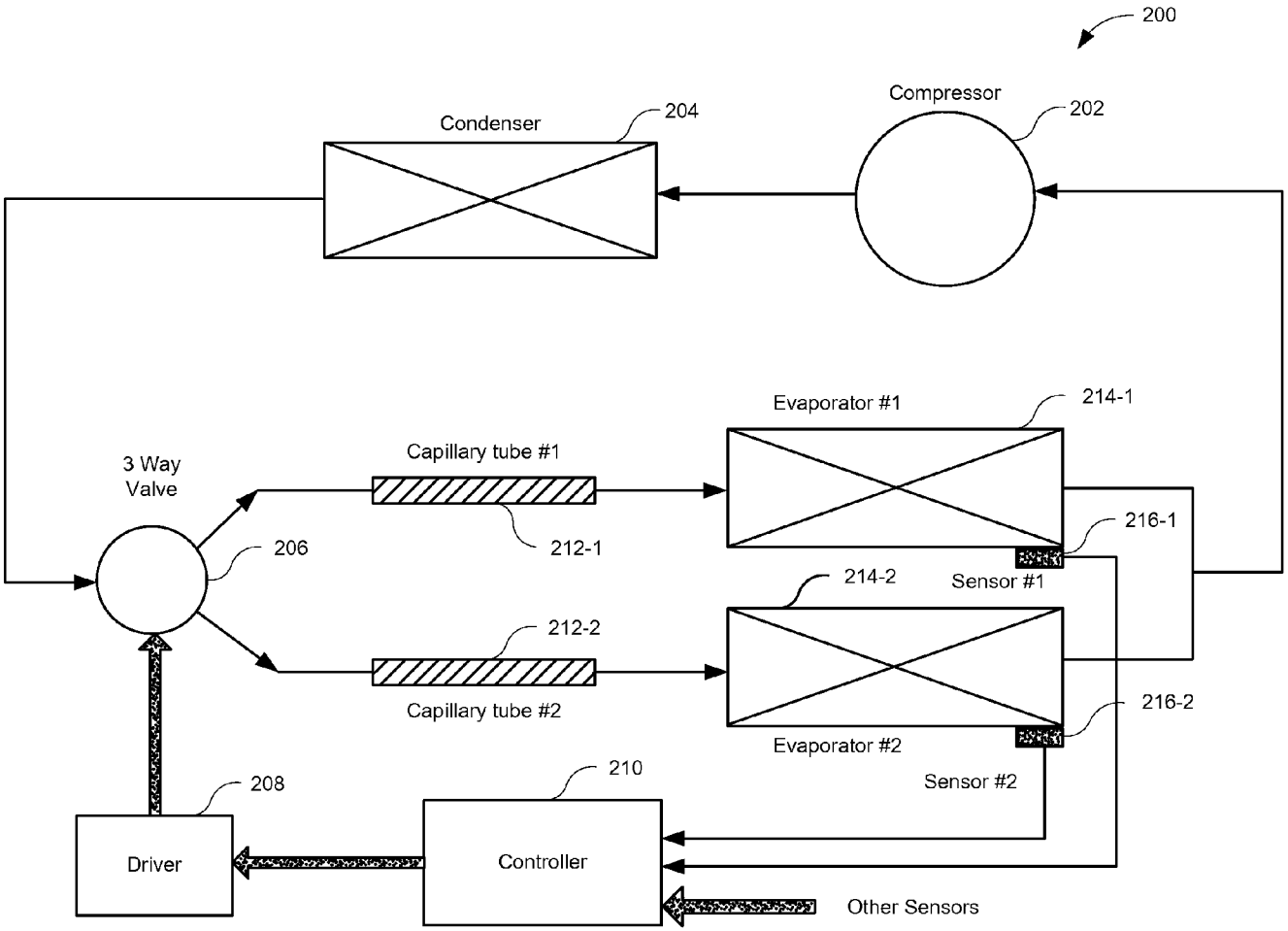
FIG. 2 is a diagram of a vapor-compression refrigeration system, in accordance with a first embodiment of the invention.

FIG. 2 is a diagram of a vapor-compression refrigeration system, in accordance with a first embodiment of the invention. It is to be understood that refrigerant flow control techniques of the invention may be applied in the vapor-compression refrigeration system 100 of FIG. 1. Prior to describing the refrigerant flow control techniques of the invention, a general description of the vapor-compression refrigeration system will first be provided below.

The vapor-compression refrigeration system uses a circulating refrigerant as the medium which absorbs and removes heat from the compartment or compartments to be cooled and subsequently expels the heat elsewhere. A refrigerant is a compound used in a heat cycle that reversibly undergoes a phase change from a gas to a liquid. Examples of refrigerants used in refrigerator appliances include but are not limited to the R-12, R-22, and R-134*a*. While certain older refrigerants are being phased out and replaced by environmentally-friendlier compounds, it is to be understood that the principles of the invention are not limited to any particular refrigerant.

As shown in FIG. 2, a refrigeration system referred to as a dual stage vapor-compression system 200 is shown. Circulating refrigerant enters a compressor 202 in a thermodynamic state known as a "saturated vapor" and is compressed to a higher pressure in the compressor 202, resulting in a higher temperature as well. The hot, compressed vapor exiting the compressor 202 is then in a thermodynamic state known as a "superheated vapor," i.e., it is at a temperature and pressure at which it can be condensed with typically available cooling water or cooling air. Thus, the hot vapor is routed through a condenser 204 where it is cooled and condensed into a liquid by flowing through a coil or tubes with cool water or cool air flowing across the coil or tubes of the condenser. The cool air may typically be air in the room in which the refrigerator operates. It is to be understood that the condenser 204 is where the circulating refrigerant rejects heat from the system and the rejected heat is carried away by either the water or the air (dependent on which one the condenser uses).

The condensed liquid refrigerant, in a thermodynamic state known as a "saturated liquid," is next routed to a refrigerant flow valve 206 where its flow rate and direction is controlled via a valve driver 208 and refrigerant flow controller 210, as will be explained below in detail. The refrigerant flow valve 206, having two outputs, passes refrigerant either separately or simulatenously to the two evaporators 214-1 and 214-2 in the system. For example, evaporator 214-1 may be located in the freezer compartment of refrigerator 100 in FIG. 1, while evaporator 214-2 may be located in the fresh food compartment of the refrigerator 100.

However, as shown in FIG. 2, before entering the evaporators 214-1 and 214-2 after leaving the refrigerant flow valve 206, the refrigerant passes through respective expansion valves known as capillary tubes 212-1 and 212-2. The refrigerant undergoes an abrupt reduction in pressure in the capillary tubes. That pressure reduction results in the flash evaporation of a part of the liquid refrigerant. The so-called "auto-refrigeration" effect of the flash evaporation lowers the temperature of the liquid and vapor refrigerant mixture to where it is colder than the temperature of the enclosed compartment to be refrigerated.

The cold mixture is then routed through a coil or tubes in the respective evaporators 214-1 and 214-2. In each compartment to be cooled by a respective evaporator, a fan (not shown) respectively circulates the warm air in the enclosed compartment across the coil or tubes of the evaporator carrying the cold refrigerant liquid and vapor mixture. The warm air evaporates the liquid part of the cold refrigerant mixture. At the same time, the circulating air is cooled and thus lowers the temperature of the enclosed compartment to a desired temperature. It is to be undertsood that the evaporator is where the circulating refrigerant absorbs and removes heat which is subsequently rejected in the condenser and transferred elsewhere by the water or air used in the condenser. To complete the refrigeration cycle, the refrigerant vapor exits each evaporator, again as a "saturated vapor," and is routed back into the compressor 202 to start a new cycle.

Note that temperature sensors 216-1 and 216-2 respectively located in the compartments to be cooled measure and report the temperatures in the respective compartments. A signal is sent by each sensor (261-1 and 216-2) to the refrigerant flow controller 210 (which in an electronic refrigerator system may be a microprocessor) indicative of the temperature (i.e., containing the temperature reading) in the compartment. As will be further explained below in the context of FIGS. 6-10, the controller 210 then sends a signal to the valve driver 208 so as to direct the refrigerant control valve 206 to certain operating positions. These operating positions will be described in detail below. In general, it is to be understood that the operating positions affect the flow rate and direction of the refrigerant to the evaporators such that the temperature in the compartments being cooled can be closely controlled and thus maintained or adjusted.

Note that in addition to sensors 216-1 and 216-2, other sensors can also provide other signals indicative of other operating and/or environmental conditions to the controller 210.

Figure 3:
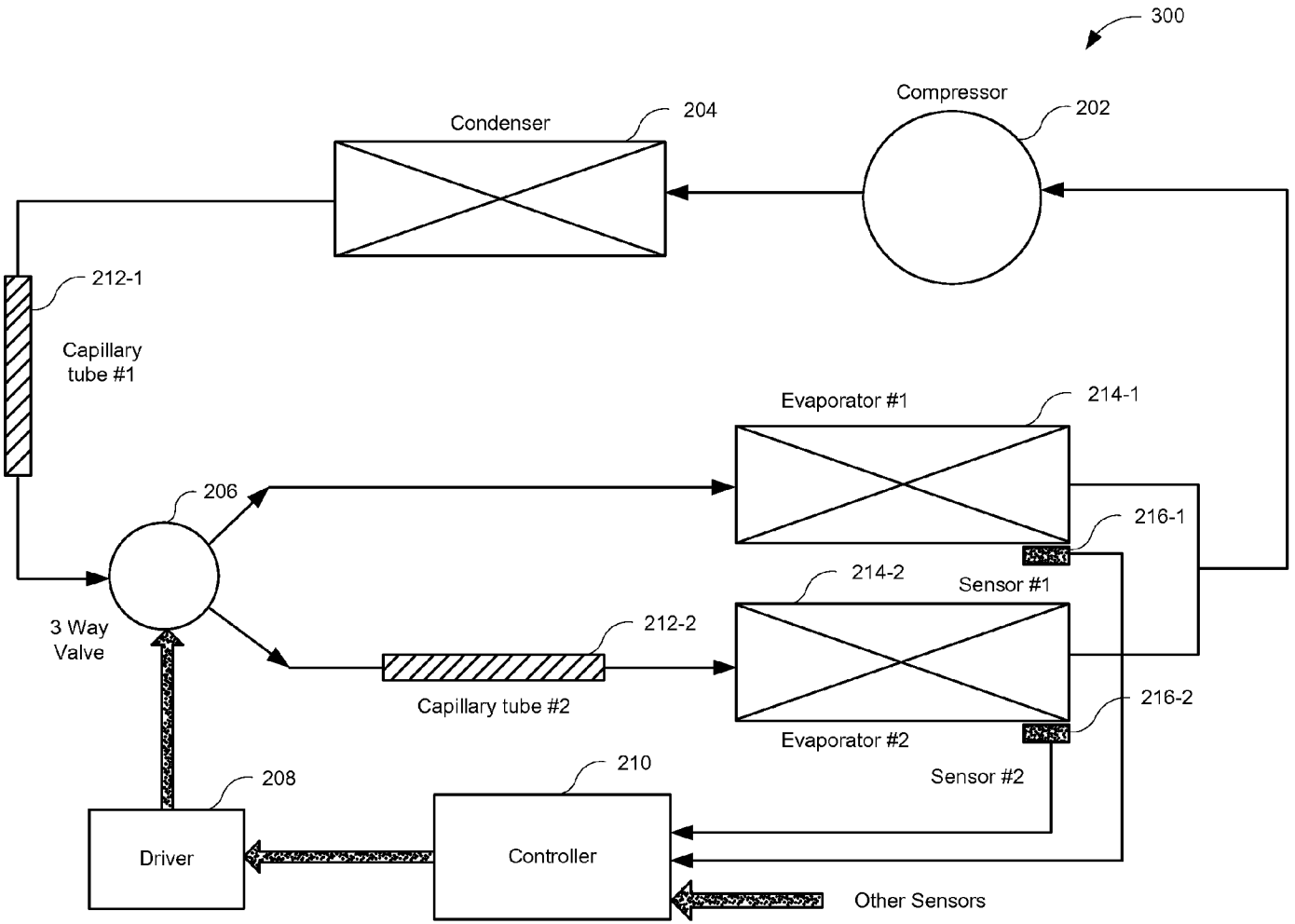
FIG. 3 is a diagram of a vapor-compression refrigeration system, in accordance with a second embodiment of the invention.

Note that the refrigeration system 200 in FIG. 2 is a dual evaporator system with the evaporators in parallel. A variation of this parallel evaporator system is shown in the vapor-compression system 300 of FIG. 3. Note that all components in system 300 operate the same or similar to those identically-labeled components of system 200 in FIG. 2. However, as shown in FIG. 3, capillary tube 212-1 is located between the output of the condenser 204 and the input of the refrigerant flow valve 206 (rather than between valve 206 and evaporator 214-1 as in FIG. 2). Recall that the refrigerant passing through the tube is subject to a flash evaporation which lowers the temperature of the liquid and vapor refrigerant mixture. Thus, by passing the refrigerant through capillary tube 212-1 before going through the refrigerant flow valve 206, the temperature of the refrigerant is lower as it passes through the valve and can then be passed directly to evaporator 214-1. However, note that before any refrigerant goes to evaporator 214-2, it passes through the second capillary tube 212-2, where the temperature of the refrigerant is again lowered.

Figure 4:
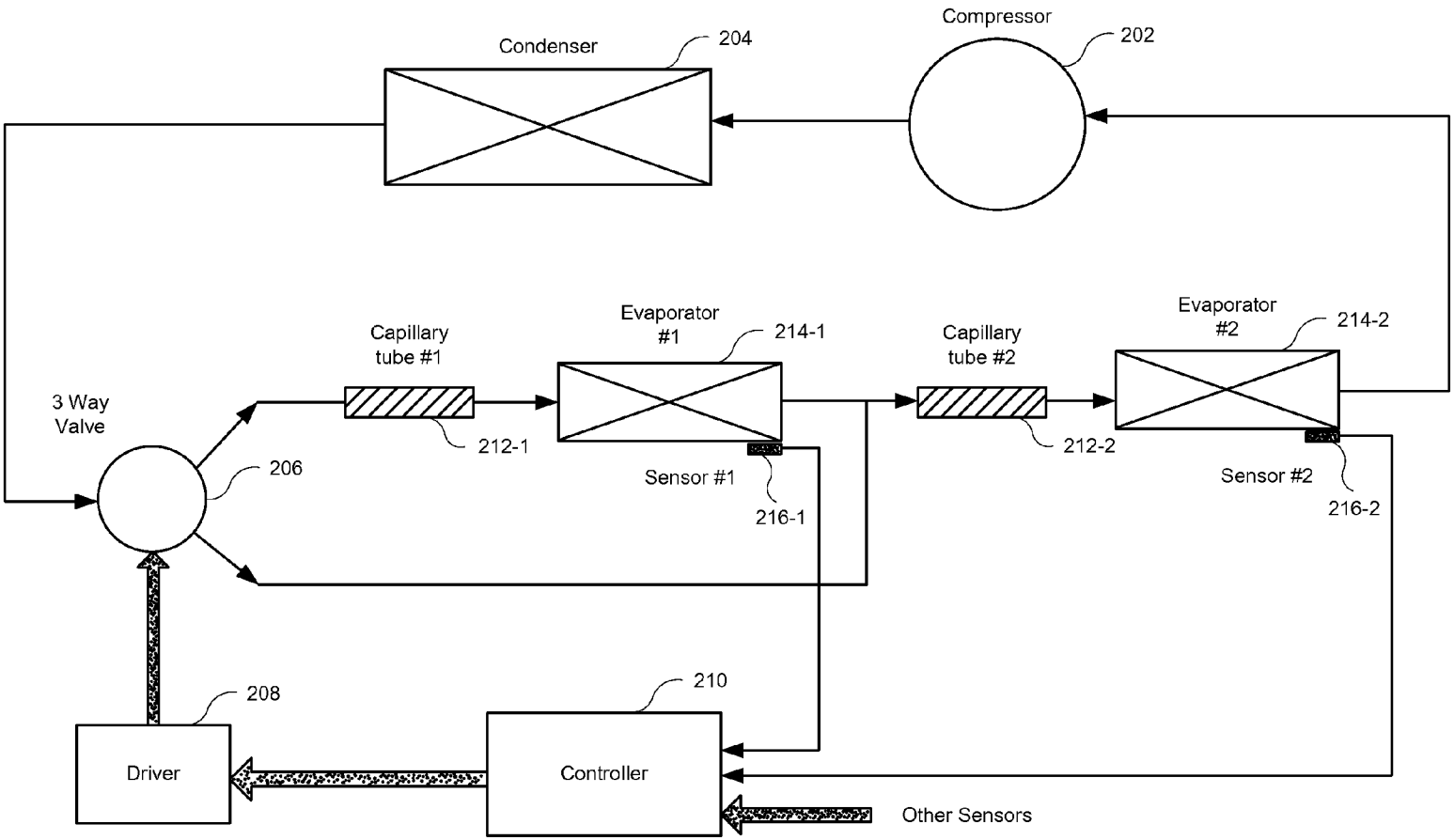
FIG. 4 is a diagram of a vapor-compression refrigeration system, in accordance with a third embodiment of the invention.
Figure 5:
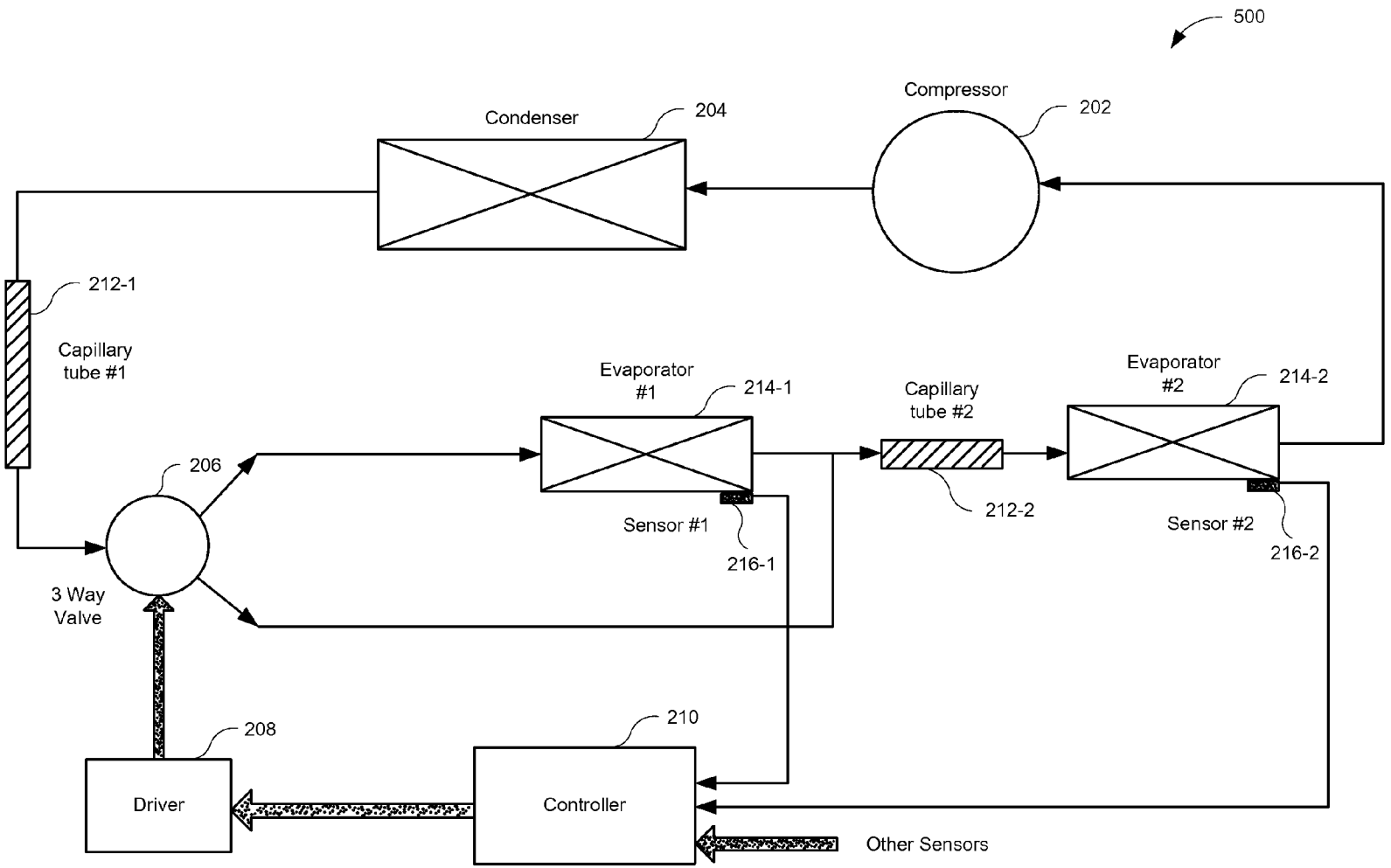
FIG. 5 is a diagram of a vapor-compression refrigeration system, in accordance with a fourth embodiment of the invention.

FIGS. 4 and 5 show embodiments of a vapor-compression system with the evaporators in a serial configuration. System 400 in FIG. 4 shows the output of evaporator 214-1 feeding into capillary tube 212-2 along with one of the outputs of the refrigerant flow valve 206. System 500 shows an alternate serial embodiment similar to the alternate parallel embodiment of FIG. 3, i.e., where the capillary tube 212-1 is located between the output of the condenser 204 and the input of the refrigerant flow valve 206. Note that all components in system 400 and system 500 operate the same or similar to those identically-labeled components of system 200 in FIG. 2.

Figure 6:
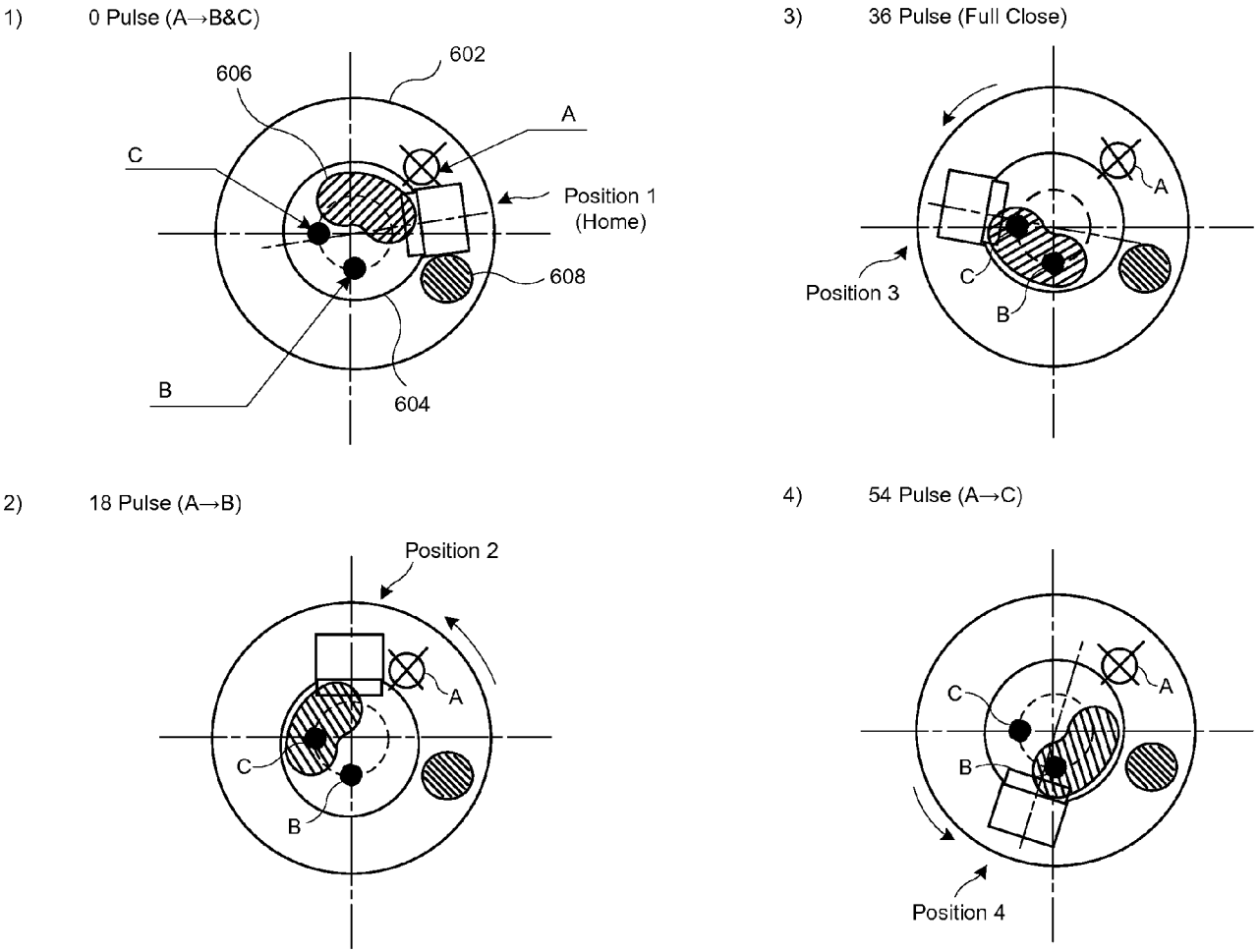
FIG. 6 is a diagram of the typical four positions of a three-way refrigerant flow valve.
Figure 7:
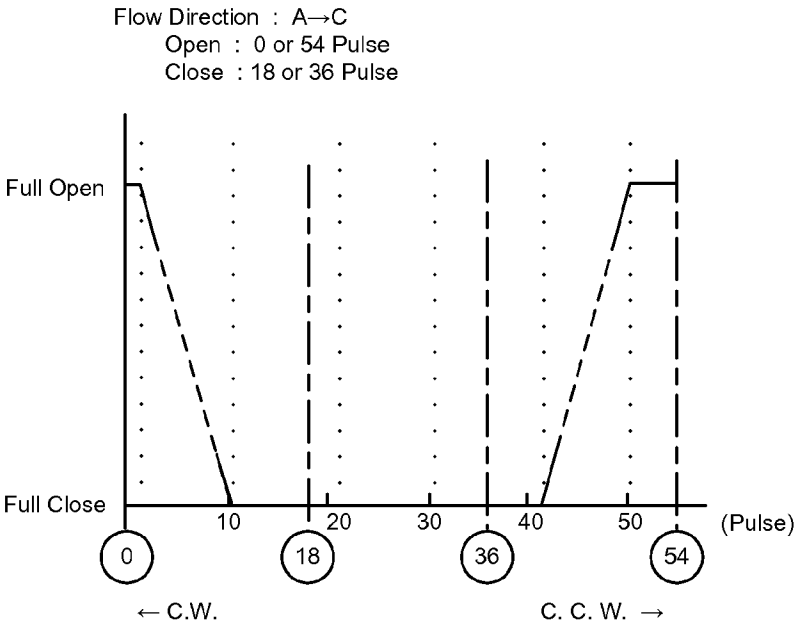
FIG. 7 is a diagram of a timing chart corresponding to the typical four positions of the three-way refrigerant flow valve in FIG. 6.
Figure 7:
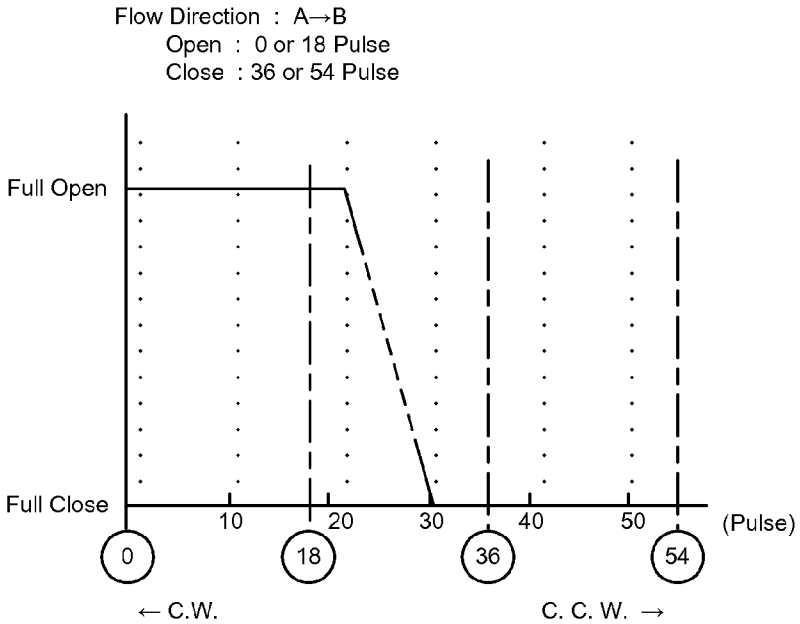

Turning now to FIGS. 6 and 7, diagrams show the standard four positions of a three-way refrigerant flow valve, and a timing chart associated therewith. It is to be understood that refrigerant flow valve 206 shown in FIGS. 2-5 may be operated in these four operating positions. However, as will be further illustrated in the context of FIGS. 8-10 in accordance with embodiments of the invention, the refrigerant flow valve 206, and thus the refrigerator appliance in which it functions, may also be purposefully operated in one or more transition positions in between certain of the standard operating positions shown in FIGS. 6 and 7. By so doing, as will be evident, the refrigerant flow valve 206 is controlled so as to provide for variable flow rates into each evaporator that the valve feeds. That is, in the case of the three-way valve 206, the refrigerant flow controller 210 directs the valve 206, via valve driver 208, to one or more of the transition positions so that the percentage of refrigerant flow to each of the two evaporators is controlled (maintained or adjusted as desired), and thus the respective temperatures of the compartments being cooled by the two evaporators are correspondingly controlled (maintained or adjusted as desired).

While principles of the invention are not limited to use with any specific refrigerant flow valve, a three-way refrigerant flow valve available from Saginomiya Seisakusho, Inc. (Tokyo, Japan) may be employed. By way of example only, a Saginomiya three-way valve model ZKV-C09DU15 may be employed.

As mentioned above, the three-way valve is typically used in a dual evaporator refrigerator to be able to cool the fresh food evaporator and freezer evaporator separately or simultaneously. In existing operation, three-way valve typically has only four positions (referred to herein as "standard positions") to control the flow of the refrigerant with respect to these two evaporators.

FIG. 6 illustrates these four standard positions: position 1 or home position (upper left of FIG. 6); position 2 (lower left of FIG. 6); position 3 (upper right of FIG. 6); and position 4 (lower right of FIG. 6). As shown, the body of the valve is labeled 602. The input port (i.e., coupled to condenser 204 in FIGS. 2-5) is labeled A. The first output port (i.e., indirectly coupled to evaporator 214-1 via capillary tube 212-1 in FIGS. 2 and 4, and directly coupled to evaporator 214-1 in FIGS. 3 and 5) is labeled B. The second output port (i.e., indirectly coupled to evaporator 214-2 via capillary tube 212-2 in FIGS. 2-5) is labeled C. The rotating portion of the valve is labeled 604, the blocker portion of the valve is labeled 606, and the stopper portion of the valve is labeled 608. The same features are shown in each of the four views of the valve in FIG. 6; however, they are not labeled in each view for the sake of clarity.

The valve operates as follows. The refrigerant flow controller 210 sends a signal (recall that this signal is generated in response to temperature feedback provided by sensors 216-1 and 216-2) to the valve driver 208. Note that, in one embodiment, the controller 210 is a microprocessor or central processing unit (CPU) whose function is controlled by suitable software or firmware programmed to implement the inventive refrigerant flow control techniques described herein. Further, in one embodiment, the valve driver 208 is a step motor which receives a signal from the controller 210 containing a predetermined number of pulses that correspond to how many steps the motor is to take. It is to be understood that the rotating portion 604 of the valve is operatively coupled to a shaft of the step motor such that, as the shaft of the step motor rotates in stepping motion, the rotating portion 604 of the valve moves to the various operating positions.

In general, the rotating portion 604 of the valve may be rotated in a counterclockwise manner to each of the operating positions. However, initially, the valve is driven clockwise to position 1 or home position (upper left of FIG. 6). This may be done in an initialization state, e.g., when refrigerator is turned on. The home position is considered the substantially fully opened position since, as shown, both output ports B and C are opened and coupled to the input port A. This corresponds to both evaporators being simultaneously on. Note that the refrigeration system ensures that the valve is at the initialization or home position at start up by driving the rotating portion 604 of the valve into the stopper portion 608.

To direct the valve to the next position, position 2 (lower left of FIG. 6), the controller 210 sends a signal with 18 pulses (corresponding to 18 steps) to the valve driver 208 to drive the rotating portion 604 of the valve in a counterclockwise direction such that the blocker portion 604 on the valve covers (blocks) the output port C while leaving opened output port B, as shown. In this position, assuming that the first evaporator is coupled to output B and the second evaporator is coupled to output C, the first evaporator is on and the second evaporator is off.

To direct the valve to the next position, position 3 (upper right of FIG. 6), the controller 210 sends a signal with another 18 pulses (corresponding to 18 more steps) to the valve driver 208 to drive the rotating portion 604 of the valve in a counterclockwise direction such that the blocker portion 604 on the valve covers (blocks) both output ports B and C. In this position, both evaporators are off. This is considered the substantially fully closed position for the valve.

To direct the valve to the next position, position 4 (lower right of FIG. 6), the controller 210 sends a signal with another 18 pulses (corresponding to 18 more steps) to the valve driver 208 to drive the rotating portion 604 of the valve in a counterclockwise direction such that the blocker portion 604 on the valve covers (blocks) the output port B while leaving opened output port C. In this position, again assuming that the first evaporator is coupled to output B and the second evaporator is coupled to output C, the second evaporator is on and the first evaporator is off.

It is to be appreciated that the controller 210 can drive the valve from the home position directly to position 3 by sending a signal to the valve driver 208 with 36 pulses (corresponding to 36 steps) or directly to position 4 by sending a signal to the valve driver with 54 pulses (corresponding to 54 steps). Also, the controller 210 can drive the valve in the clockwise direction by sending a signal to the valve driver that contains the amount of pulses corresponding to the position, for example, if at position 4, the valve can be driven clockwise to position 0 or the home position by sending a signal with zero pulses. FIG. 7 illustrates a timing chart that shows the correlation between the number of pulses and the four standard operating positions of the refrigerant flow valve 206.

However, illustrative principles of the invention realize that by operating the valve 206 in only the four standard positions, only the direction of refrigerant flow can be controlled. That is, the four positions only allow for both output ports to be substantially fully opened or substantially fully closed, or for one output port to be substantially fully opened and the other output port to be substantially fully closed. This corresponds to the evaporators operating simultaneously or separately. As an example, with a refrigerator that has one evaporator in the freezer compartment and the other evaporator in the fresh food compartment, the four standard positions allow only for operating the fresh food evaporator alone, operating the freezer evaporator alone, operating both evaporators, or both evaporator being off. It is to be understood that "substantially fully opened" means that the output port can feed about 100 percent of the refrigerant input to the valve to the capillary tube or evaporator, while "substantially fully closed" means that about zero percent of the refrigerant input to the valve is fed to the capillary tube or evaporator.

Advantageously, illustrative principles of the invention provide for directing the refrigerant flow valve 206, via the refrigerant flow controller 210, to at least one transition position between the substantially fully opened position and the substantially fully closed position, and purposefully operating the refrigerator with the refrigerant flow valve at the at least one transition position. It is to be understood that the phrase "transition position" refers to an operating position of the refrigerant flow valve other than the four standard positions shown and described in the context of FIG. 6.

That is, illustrative principles of the invention utilize transition positions between the standard positions to control the refrigerant flow rate into an evaporator in order to more closely control the temperature in the compartment being cooled by the evaporator. Thus, the three-way valve operated according to embodiments of the invention not only switches the path of the refrigerant, but also controls the refrigerant flow rate into the evaporator to adjust the evaporator temperature in real time to the desired target based on the operating condition and/or environment. Such evaporator temperature control in real time achieves improved performance and energy consumption in the refrigerator appliance.

Figure 8:
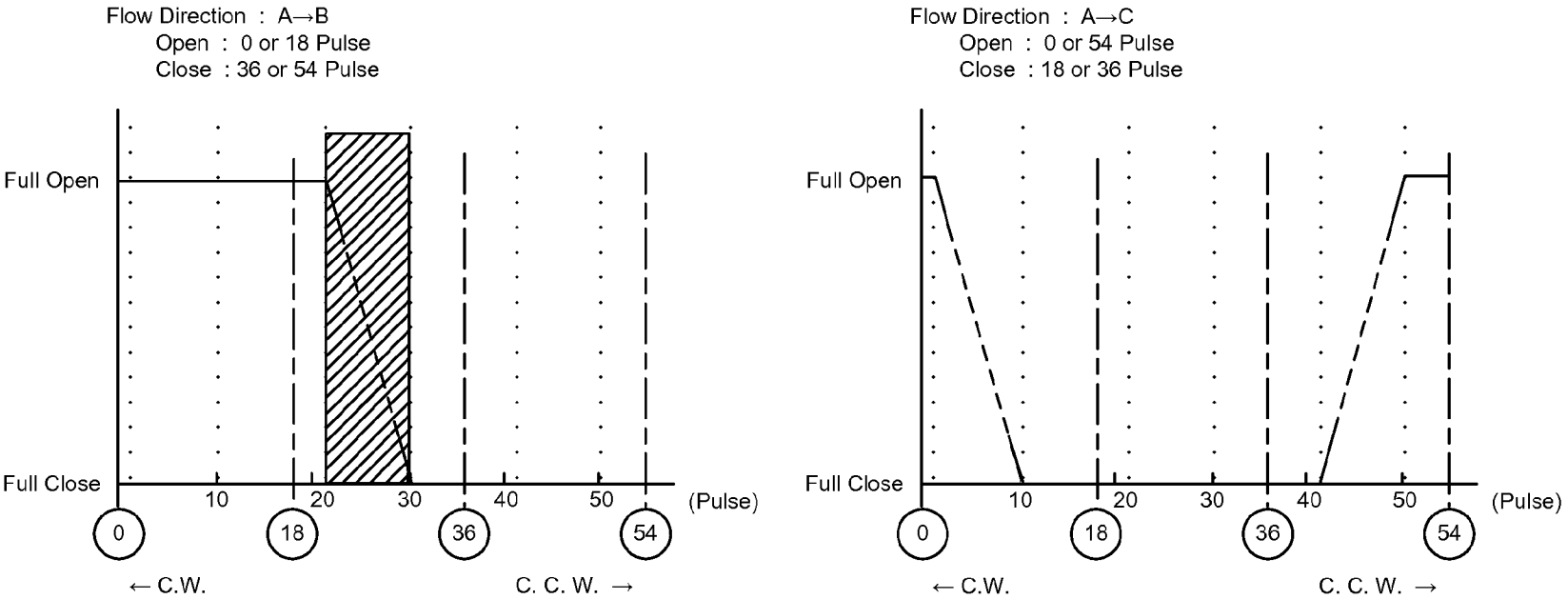
FIG. 8 is a diagram of a timing chart corresponding to operation of a refrigerant flow valve in transition positions, in accordance with an embodiment of the invention.
Figure 9:
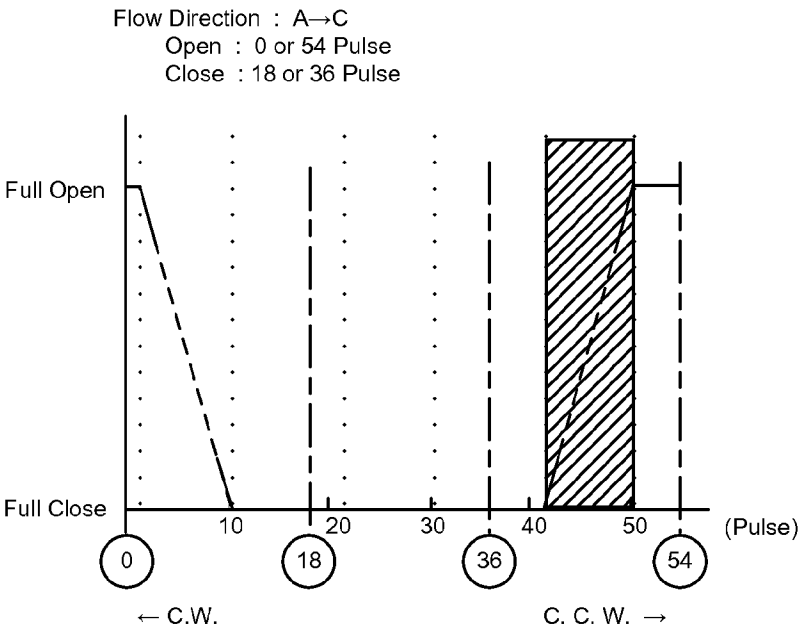
FIG. 9 is a diagram of a timing chart corresponding to operation of a refrigerant flow valve in transition positions, in accordance with another embodiment of the invention.
Figure 9:
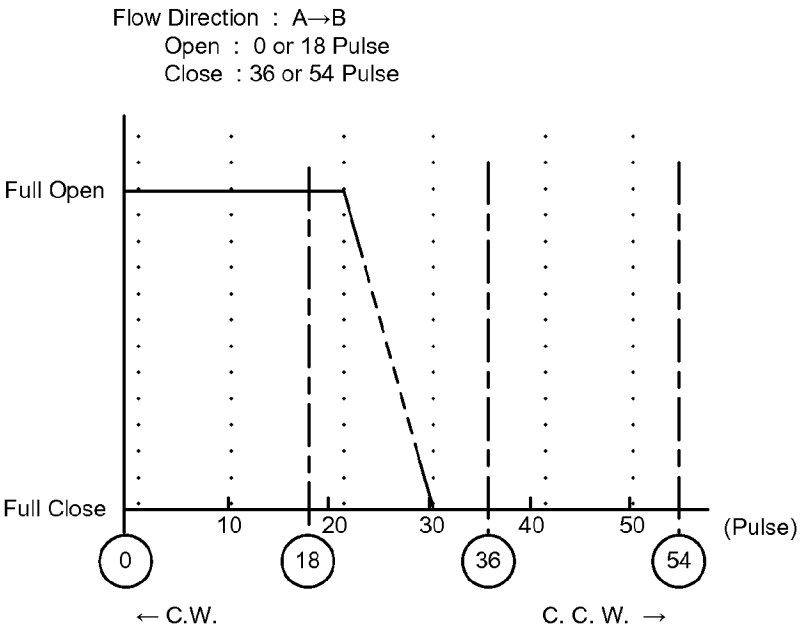
Figure 10:
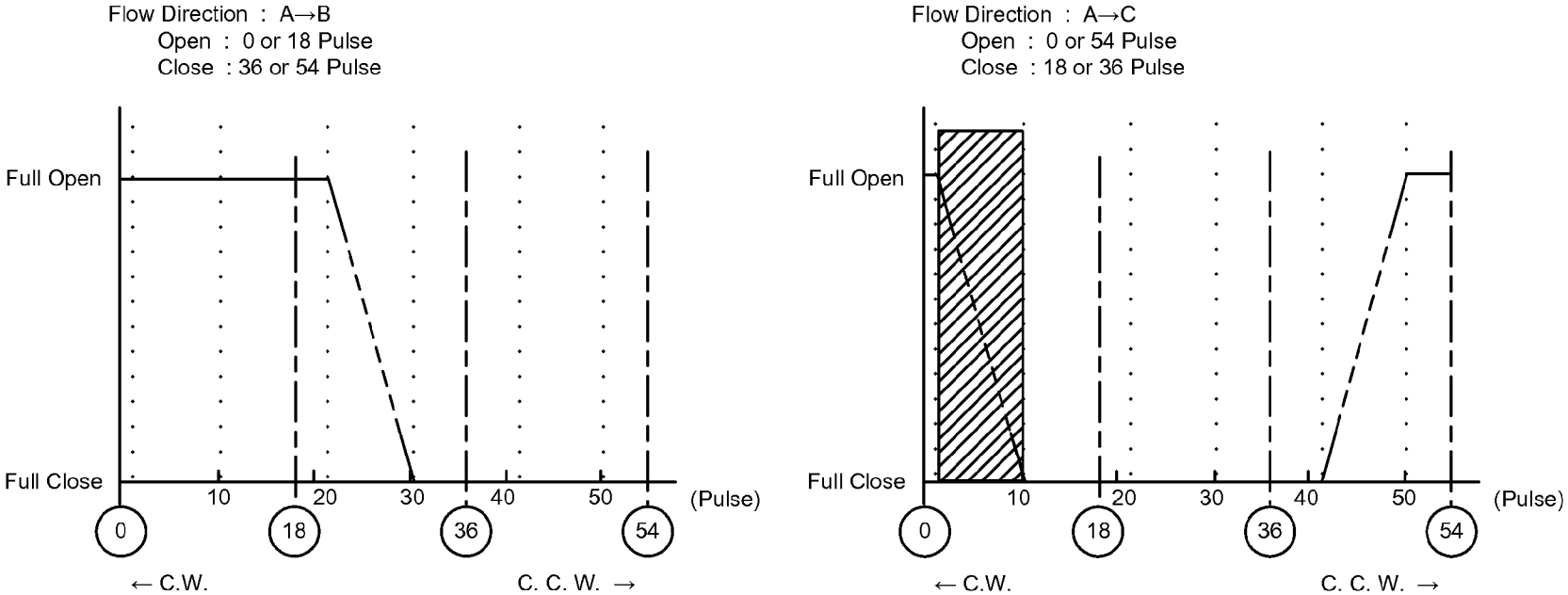
FIG. 10 is a diagram of a timing chart corresponding to operation of a refrigerant flow valve in transition positions, in accordance with yet another embodiment of the invention.

FIGS. 8-10 illustrate timing charts corresponding to operation of a refrigerant flow valve in transition positions, in accordance with various embodiments of the invention.

For example, as illustrated in FIG. 8, the refrigerant flow controller 210 sends a signal with a selected amount of pulses between about 20 and 30 pulses to the valve driver 208 (FIG. 8 shows pulse range to be about 22 to 30 pulses, but this is for illustrative purposes only). Note with reference back to FIG. 6, assuming that the resolution is one pulse equals one step (although principles of the invention are not limited to such a 1:1 correspondence, e.g., correspondence could be 2:1 or 1:2, or any suitable ratio), 20 to 30 pulses could correspond to about ten transition positions between standard positions 2 and 3. Thus, for flow direction A to B (left side of FIG. 8), the refrigerant flow rate out of output port B may be selectively adjusted between about 100 percent and about zero percent.

This range of flow rate control is depicted in FIG. 8 by shaded area 802. For example, when the controller 210 drives the valve 206, via valve driver 208, with a signal containing about 25 pulses, this moves the rotating portion 604 of the valve such that the blocker portion 606 covers about half of the opening of output port B. Thus, the refrigerant flow rate out of output port B is about 50 percent. However, since existing three-way refrigerant flow valves tend to be non-linear in response, it should be understood that the correspondence between pulses and flow rates is not necessarily linear (the same is true for the examples described below in the context of FIGS. 9 and 10). Nonetheless, it is clear that with a plurality of transition positions, the refrigerant flow rate of output port B can be selected to be a percentage value that is less than about 100 percent and greater than about zero percent, with each selected transition position corresponding to a different flow rate over such range (increasing or decreasing, depending on what direction the valve is being driven). Recall that the substantially fully opened position of output port B is about 100 percent (standard position 2) and the substantially fully closed position of output port B is about zero percent (position 3). Thus, use of the transition positions allows the refrigeration system to control the flow of refrigerant and thus the compartment temperature in fine resolution increments. Note also that, all the while when operating output port B at transition positions between standard positions 2 and 3, output port C is substantially fully closed (blocker portion 606 remains over the port) as shown on right side of FIG. 8.

FIG. 9 shows another example of refrigerant flow control using transition positions in accordance with the inventive teachings. In this example, the refrigerant flow controller 210 sends a signal with a selected amount of pulses between about 40 and 50 pulses to the valve driver 208. Note that 40 to 50 pulses could correspond to about ten transition positions between standard positions 3 and 4. Again, this assumes a 1:1 pulse/step correspondence. Thus, for flow direction A to C (right side of FIG. 9), the refrigerant flow rate out of output port C may be selectively adjusted between about zero percent and about 100 percent, with each selected transition position corresponding to a different flow rate over such range (increasing or decreasing, depending on what direction the valve is being driven). Note that this is while output port B is substantially fully closed. Recall again that the substantially fully opened position of output port C is about 100 percent (standard position 4) and the substantially fully closed position of output port C is about zero percent (position 3).

FIG. 10 shows another example of refrigerant flow control using transition positions in accordance with the inventive teachings. In this example, the refrigerant flow controller 210 sends a signal with a selected amount of pulses between about 2 and 10 pulses to the valve driver 208. Here, assuming 1:1 pulse/step correspondence as above, 2 to 10 pulses could correspond to about ten transition positions between standard positions 1 and 2. Thus, for flow direction A to C (right side of FIG. 10), the refrigerant flow rate out of output port C may be selectively adjusted between about 100 percent and about zero percent, with each selected transition position corresponding to a different flow rate over such range (increasing or decreasing, depending on what direction the valve is being driven). Note that this is while output port B is substantially fully opened. Recall again that the substantially fully opened position of output port C is about 100 percent (standard position 1) and the substantially fully closed position of output port C is about zero percent (position 2).

It is to be understood that, based on the particular flow valve employed in the refrigeration system being controlled in accordance with principles of the invention, transition position and flow rate correspondence other than the correspondence examples described above can be realized.

Furthermore, recall the capillary tubes in the refrigeration systems described above in the context of FIGS. 2 through 5. In theory, the capillary tube(s) is not required on the side of the valve which will operate at a selected transition position since the refrigerant flow can now be regulated by the three-way valve. However, in practice, use of the capillary tube is preferred for at least two reasons:

(1) The capillary tube can be bonded with the return line of the evaporator such that the refrigerant can be pre-cooled before entering the evaporator. This practice improves energy efficiency.

(2) The capillary tube can shift the range of the three-way valve to an optimal position. For example, assume the three-way valve operates at about 30% to 60% of the substantially fully opened position without a capillary tube. By adding a capillary tube which will reduce the flow rate by about 20%, now the three-way valve can run from about 50% to 80% to achieve the same refrigerant flow. The three-way valve will operate with a wider opening which will reduce the chance of clogging.

It is to be further appreciated that one ordinarily skilled in the art will realize that well-known heat exchange and heat transfer principles may be applied to determine appropriate dimensions and materials of the various assemblies illustratively described herein, as well as flow rates of refrigerant that may be appropriate for various applications and operating conditions, given the inventive teachings provided herein. While methods and apparatus of the invention are not limited thereto, the skilled artisan will realize that such rates, dimensions and materials may be determined and selected in accordance with well-known heat exchange and heat transfer principles as described in R. K. Shah, "Fundamentals of Heat Exchanger Design," Wiley & Sons, 2003 and F. P. Incropera et al., "Introduction to Heat Transfer," Wiley & Sons, 2006, the disclosures of which are incorporated by reference herein.

It is to be further appreciated that the refrigeration systems described herein may have control circuitry including, but not limited to, a microprocessor (processor) that is programmed, for example, with suitable software or firmware, to implement one or more techniques as described herein. One example is refrigerant flow controller 210. In other embodiments, an ASIC (Application Specific Integrated Circuit) or other arrangement could be employed. One of ordinary skill in the art will be familiar with refrigeration systems and given the teachings herein will be enabled to make and use one or more embodiments of the invention; for example, by programming a microprocessor with suitable software or firmware to cause the refrigeration system to perform illustrative steps described herein. Software includes but is not limited to firmware, resident software, microcode, etc. As is known in the art, part or all of one or more aspects of the invention discussed herein may be distributed as an article of manufacture that itself comprises a tangible computer readable recordable storage medium having computer readable code means embodied thereon. The computer readable program code means is operable, in conjunction with a computer system or microprocessor, to carry out all or some of the steps to perform the methods or create the apparatuses discussed herein. A computer-usable medium may, in general, be a recordable medium (e.g., floppy disks, hard drives, compact disks, EEPROMs, or memory cards) or may be a transmission medium (e.g., a network comprising fiber-optics, the world-wide web, cables, or a wireless channel using time-division multiple access, code-division multiple access, or other radio-frequency channel). Any medium known or developed that can store information suitable for use with a computer system may be used. The computer-readable code means is any mechanism for allowing a computer or processor to read instructions and data, such as magnetic variations on magnetic media or height variations on the surface of a compact disk. The medium can be distributed on multiple physical devices. As used herein, a tangible computer-readable recordable storage medium is intended to encompass a recordable medium, examples of which are set forth above, but is not intended to encompass a transmission medium or disembodied signal. A microprocessor may include and/or be coupled to a suitable memory.

Furthermore, it is also to be appreciated that methods and apparatus of the invention may be implemented in electronic systems under control of one or more microprocessors and computer readable program code, as described above, or in electromechanical systems where operations and functions are under substantial control of mechanical control systems rather than electronic control systems.

Thus, while there have been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method of controlling a flow of a refrigerant in an appliance comprising a refrigerant flow controller and a refrigerant flow valve, wherein the refrigerant flow controller is configured to direct the refrigerant flow valve to one of a substantially fully opened position and a substantially fully closed position, the method comprising:

directing the refrigerant flow valve, via the refrigerant flow controller, to at least one transition position between the substantially fully opened position and the substantially fully closed position; and operating the appliance with the refrigerant flow valve at the at least one transition position;

wherein the appliance comprises a first evaporator and a second evaporator, the refrigerant flow valve comprising a three-way valve coupled to the first evaporator, the second evaporator and the refrigerant flow controller.

2. The method of claim 1, wherein the refrigerant flow valve regulates, responsive to the refrigerant flow controller, respective flow of the refrigerant to the first evaporator and the second evaporator.

3. The method of claim 2, wherein, when the refrigerant flow valve is directed to the at least one transition position, the refrigerant flow to one of the first evaporator and the second evaporator is regulated to a flow rate in between a flow rate associated with the substantially fully opened position and a flow rate associated with the substantially fully closed position, while the refrigerant flow to the other of the first evaporator and the second evaporator is regulated to a flow rate associated with one of the substantially fully opened position and the substantially fully closed position.

4. The method of claim 1, further comprising receiving at the refrigerant flow controller a signal from at least one sensor indicative of at least one condition in the appliance.

5. The method of claim 4, wherein the at least one condition comprises a temperature in a compartment of the appliance in which the refrigerant flows.

6. The method of claim 5, wherein the compartment is one of a freezer compartment and a fresh food compartment.

7. The method of claim 4, further comprising generating a signal in the refrigerant flow controller, responsive to the signal received from the at least one sensor, to cause the refrigerant flow valve to be directed to the at least one transition position.

8. The method of claim 7, further comprising receiving at a valve driver the signal generated by the refrigerant flow controller, wherein the valve driver is coupled to the refrigerant flow valve and the valve driver moves the refrigerant flow valve to the at least one transition position.

9. The method of claim 8, wherein the valve driver comprises a step motor.

10. The method of claim 1, wherein the refrigerant flow controller is configured to direct the refrigerant flow valve to two or more transition positions wherein each of the two or more transition positions represents a different flow percentage between about zero percent and about one hundred percent.

11. A method of controlling a flow of a refrigerant in an appliance comprising a refrigerant flow controller and a refrigerant flow valve, wherein the refrigerant flow controller is configured to direct the refrigerant flow valve to one of a substantially fully opened position and a substantially fully closed position, the method comprising:

directing the refrigerant flow valve, via the refrigerant flow controller, to at least one transition position between the substantially fully opened position and the substantially fully closed position; and operating the appliance with the refrigerant flow valve at the at least one transition position;

wherein the method further comprises:

receiving at the refrigerant flow controller a signal from at least one sensor indicative of at least one condition in the appliance;

generating a signal in the refrigerant flow controller, responsive to the signal received from the at least one sensor, to cause the refrigerant flow valve to be directed to the at least one transition position; and receiving at a valve driver the signal generated by the refrigerant flow controller, wherein the valve driver is coupled to the refrigerant flow valve and the valve driver moves the refrigerant flow valve to the at least one transition position;

wherein the signal generated by the refrigerant flow controller and received by the valve driver comprises a predetermined number of pulses corresponding to the at least one transition position.

12. An appliance comprising:

a refrigerant flow controller;

a first evaporator;

a second evaporator; and a refrigerant flow valve responsive to the refrigerant flow controller, wherein the refrigerant flow controller is configured to direct the refrigerant flow valve to one of a substantially fully opened position and a substantially fully closed, and to direct the refrigerant flow valve to at least one transition position between the substantially fully opened position and the substantially fully closed position, such that the appliance is operable with the refrigerant flow valve at the at least one transition position wherein the refrigerant flow valve comprises a three-way valve coupled to the first evaporator, the second evaporator and the refrigerant flow controller.

13. The appliance of claim 12, wherein the refrigerant flow valve regulates, responsive to the refrigerant flow controller, respective flow of the refrigerant to the first evaporator and the second evaporator.

14. The appliance of claim 13, wherein, when the refrigerant flow valve is directed to the at least one transition position, the refrigerant flow to one of the first evaporator and the second evaporator is regulated to a flow rate in between a flow rate associated with the substantially fully opened position and a flow rate associated with the substantially fully closed position, while the refrigerant flow to the other of the first evaporator and the second evaporator is regulated to a flow rate associated with one of the substantially fully opened position and the substantially fully closed position.

15. The appliance of claim 12, further comprising at least one sensor for sensing at least one condition in the appliance.

16. The appliance of claim 15, wherein the at least one condition comprises a temperature in a compartment of the appliance in which the refrigerant flows.

17. The appliance of claim 15, further comprising a valve driver coupled between the refrigerant flow controller and the refrigerant flow valve.

18. The appliance of claim 17, wherein the refrigerant flow controller receives a signal from the at least one sensor indicative of the at least one condition in the appliance, and generates a signal, responsive to the signal received from the at least one sensor, to cause the refrigerant flow valve to be directed to the at least one transition position.

19. The appliance of claim 18, wherein the valve driver receives the signal generated by the refrigerant flow controller and moves the refrigerant flow valve to the at least one transition position.

20. The appliance of claim 12, wherein the appliance comprises a refrigerator appliance.

* * * * *